US005290114A

United States Patent [19]

Asami et al.

[11] Patent Number: 5,290,114

[45] Date of Patent: Mar. 1, 1994

[54] INK RIBBON UNIT AND INK RIBBON CASSETTE

[75] Inventors: Shoziro Asami; Yasuji Yui, both of Kanagawa, Japan

[73] Assignee: Sony Corporation, Japan

[21] Appl. No.: 12,927

[22] Filed: Feb. 3, 1993

[30] Foreign Application Priority Data

Feb. 14, 1992 [JP] Japan ..... 4-027643

[51] Int. Cl.[5] ..... B41J 35/28

[52] U.S. Cl. ..... 400/208; 400/249; 400/703

[58] Field of Search ..... 400/70, 208, 249, 703, 400/719, 120; 346/76 PH, 151; 235/469, 494

[56] References Cited

U.S. PATENT DOCUMENTS

| | | | |
|---|---|---|---|
| 3,384,216 | 5/1968 | Thayer | 400/144.3 |
| 4,218,151 | 8/1980 | Kondur, Jr. | 400/320 |
| 4,910,533 | 3/1990 | Sasaki et al. | 346/151 |
| 4,970,531 | 11/1990 | Shimizu et al. | 400/249 |
| 5,037,218 | 8/1991 | Shimizu et al. | 400/237 |
| 5,079,565 | 1/1992 | Shimizu et al. | 400/249 |
| 5,087,137 | 2/1992 | Branard et al. | 400/249 |

FOREIGN PATENT DOCUMENTS

| | | | |
|---|---|---|---|
| 3292177 | 12/1991 | Japan | 400/208 |

*Primary Examiner*—Edgar S. Burr
*Assistant Examiner*—Ren Yan
*Attorney, Agent, or Firm*—Ronald P. Kananen

[57] ABSTRACT

An ink ribbon unit and an ink ribbon cassette for use in printers of thermally sublimate ink transferal type are described. The cassette comprises a casing and the ink ribbon unit installed in the casing. The ink ribbon unit comprises an ink film, a spool around which the ink film is wound, a coaxial shaft portion possessed by the spool, a ring rotatably disposed about the coaxial shaft portion of the spool, and a mark representing information on the ink film. The mark is applied to the ring to rotate therewith. Another mark similar to the above-mentioned mark is attached to the casing.

19 Claims, 6 Drawing Sheets

INK RIBBON UNIT AND INK RIBBON CASSETTE

BACKGROUND OF THE INVENTION

1. Field of the Invention

The present invention relates to ink ribbon units and ink ribbon cassettes used in printers of thermally sublimate ink transferal type.

2. Description of the Prior Art

In order to clarify the task of the present invention, one conventional ink ribbon cassette 100 will be described with reference to FIG. 10, which is used in a color printer of a thermally sublimate ink transferal type. The cassette 100 generally comprises a casing 101, feeding and winding spools 103 and 104 installed in the casing 101 and an ink ribbon 102 movably held by the spools 103 and 104. The feeding spool 103 holds an unused section of the ink ribbon 102, while, the winding spool 103 holds a used section of the ribbon 102.

The ink ribbon 102 has for example yellow ink, magenta ink and cyanine ink which are infiltrated therein at evenly spaced intervals.

In accordance with types of papers on which printing is carried out, various ink ribbon cassettes of the above-mentioned type are prepared. That is, each time the type of paper changes, an operator must change the cassette. Information (such as, number of colors, inking sensitivity, etc.,) on the ink ribbon 102 installed in the casing 101 is represented by projected/depressed marks provided on the casing 101. When the cassette 100 is inserted into the printer, an optical sensor of the printer senses the marks and thus reads the information on the ink ribbon which is ready for printing or inking. The ink ribbon cassette of this type is described in, for example, Japanese Patent First Provisional Publication 63-254085.

However, in the ink ribbon cassettes of the above-mentioned type, numerous optical sensors must be installed in the printer in order to judge the types of various ink ribbon cassettes. In fact, when using such cassettes, one optical sensor can judge only two types of cassettes and two optical sensors can judge only four types of cassettes. As is known, usage of numerous optical sensors not only increases the cost of the printer but also causes a bulky construction of the same.

In view of these drawbacks, a measure has been proposed by, for example, Japanese Patent First Provisional Publication 2-20368. In this measure, a plurality of information marks representing information (viz., the number of colors, the linking sensitivity, etc.,) on an ink ribbon in the cassette are provided on the feeding spool, not on the casing. When the cassette is put into the printer and the printer is switched ON, the winding spool is slightly turned in the direction to wind thereon the ink ribbon. With this, the feeding spool is turned in the direction to feed the ink ribbon, and thus, the information marks on the feeding spool revolve together with the feeding spool giving various information on the ink ribbon to a single optical sensor installed in the printer.

However, even the measure proposed by the 2-20368 Publication has the following drawbacks.

That is, reading the information on the ink ribbon is available only when the feeding spool is turned. However, this causes wasteful usage of the ink ribbon. In fact, a part of the unused section of the ink ribbon, which passes by a printing head of the printer under the information reading, can not contribute to the printing or inking. Furthermore, such wasteful feeding of the ink ribbon tends to produce a slack of the ink ribbon, which tends to have the unused section of the ink ribbon stained or damaged. This wasteful feeding of the ink ribbon is much severe when the feeding for the information reading takes place after the printer has been stopped in the middle of the printing.

SUMMARY OF THE INVENTION

It is therefore an object of the present invention to provide an ink ribbon cassette which is free of the above-mentioned drawbacks.

According to a first aspect of the present invention, there is provided an ink ribbon unit which comprises an ink film; a spool around which the ink film is wound; a coaxial shaft portion possessed by the spool; a ring rotatably disposed about the coaxial shaft portion of the spool; and a mark representing information on the ink film, the mark being applied to the ring to rotate therewith.

According to a second aspect of the present invention, there is provided an ink ribbon cassette which comprises a casing consisting of upper and lower case parts; an ink ribbon unit installed in the casing, the ink ribbon unit including an ink film, a spool around which the ink film is wound, a coaxial shaft portion possessed by the spool, a ring rotatably disposed about the coaxial shaft portion of the spool, and a mark representing information on the ink film, the mark being applied to the ring to rotate therewith; and another mark which represents information on the ink film, the another mark being attached to the casing.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

In the following, the present invention will be described in detail with reference to the accompanying drawings.

As will become apparent as the description proceeds, in accordance with the present invention, two types of ink ribbon structures are available, which are an ink ribbon unit 10 and an ink ribbon cassette 1. The ink ribbon cassette 1 contains therein the ink ribbon unit 10.

Figure 1:
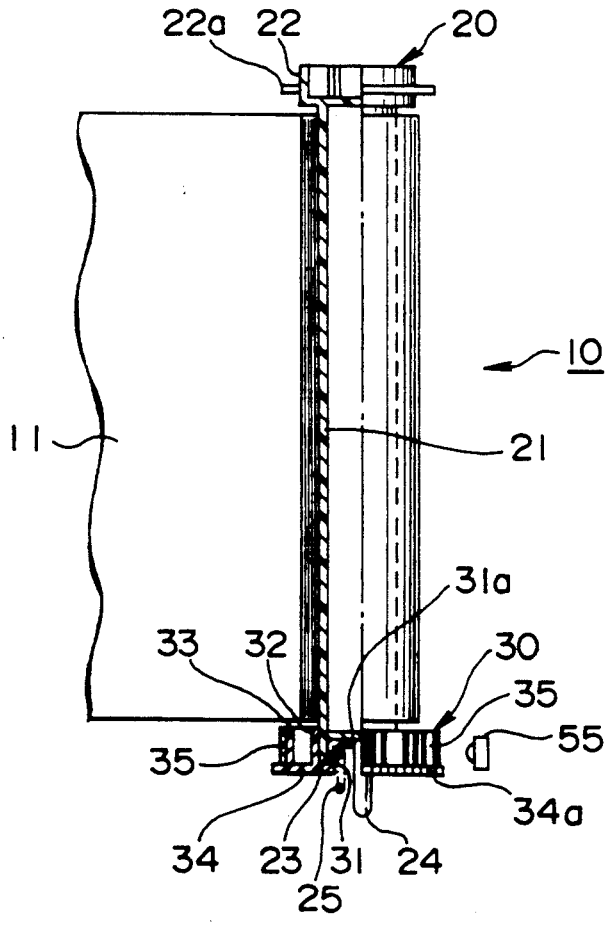
FIG. 1 is a partial plan view of an ink ribbon unit according to the present invention.

In FIG. 1, there is shown the ink ribbon unit 10 which is used in color printers of thermally sublimate ink transferal type.

The ink ribbon unit 10 comprises an ink film (or ribbon) 11 which has yellow ink (Y), magenta ink (M) and cyanine ink (C) applied thereto at evenly spaced intervals, a feeding spool 20 which has an unused section of the ink film 11 wound about a cylindrical body portion 21 thereof, and a plastic ring 30 which is rotatably disposed about a coaxial shaft portion 24 of the feeding spool 20.

The feeding spool 20 is constructed of a plastic. As shown, the cylindrical body portion 21 of the feeding spool 20 has an end 22 somewhat enlarged in diameter. The enlarged end 22 is integrally formed with a flange 22*a*. The other end 23 of the cylindrical body portion 21 has a diameter identical to that of the body portion 21 and has a circular end wall. As will become apparent as the description proceeds, a part of the ring 30 is rotatably disposed about the other end 23 of the cylindrical body portion 21. The circular end wall has the shaft portion 24 projected therefrom.

The ring 30 comprises a depressed portion 31 which has a center opening 31*a* rotatably received on the shaft portion 24 of the feeding spool 20, an inner cylindrical wall portion 33 which is rotatably disposed about the cylindrical other end 23 of the feeding spool 20, an outer cylindrical wall portion 33 which concentrically surrounds the inner cylindrical wall portion 32, and a circular plate portion 34 which is integral with the depressed, inner cylindrical wall and outer cylindrical wall portions 31, 32 and 33.

The circular plate portion 34 has at its circumference a plurality of teeth which constitute a gear 34*a*. In the illustrated embodiment, the diameter of the outer cylindrical wall portion 33 is about 24 mm.

To the outer cylindrical wall portion 33, there are stuck two ribbon code labels 35 in tandem manner, each label covering a half of the wall portion 33 and having a bar code printed thereon.

Figure 2:
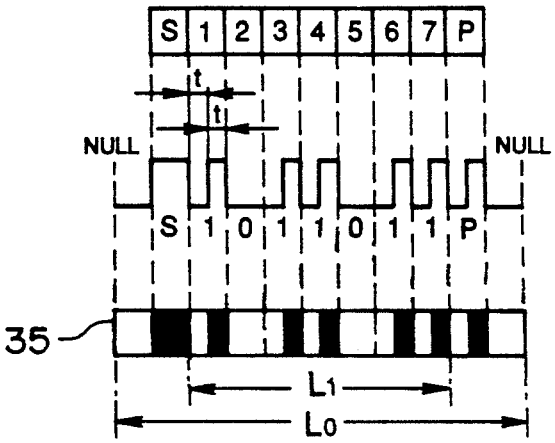
FIG. 2 is an illustration of a ribbon code label which is to be stuck on a ring rotatably held by an ink film feeding spool.

As is shown in FIG. 2, information on the ink film 11, such as inking sensitivity, type (viz., color or monochrome), inking capacity etc., is represented by the bar code. The entire length "L0" of each ribbon code label 35 is about 36 mm.

As is seen from FIG. 1, in order to read the bar code on the tandem arranged ribbon code labels 35, a known reflection type otpical sensor 55 is used. That is, with the ring 30 being rotated, the sensor 55 emits light beam toward the labels 35. When the light beam hits on white zones of the bar code, the beam is reflected (viz., "1" signal), while, when the light beam hits on black zones of the bar code, the beam is not reflected (viz., "0" signal). These white and black zones are arranged to constitute a bit pattern which includes for example, a start bit "S", 1, 2, 3, . . . 7 and a parity bit "P".

As shown in FIG. 1, a compression coiled spring 25 is associated with the ring 30. As will become apparent hereinafter, upon setting of the ink ribbon unit 10 in the printer, the spring 23 functions to press the ring 30 against the end 23 of the feeding spool 20. Due to the work of this spring 25 and a frictional force created between the inner cylindrical wall portion 32 of the ring 30 and the other end 23 of the feeding spool 20, a rotation of the feeding spool 20 can bring about a simultaneous rotation of the ring 30. While, when, with the feeding spool 20 stopped, an external force is applied through the gear 34*a* to the ring 30 in a direction to rotate the same, the ring 30 is rotated about the shaft portion 24 against the above-mentioned frictional force.

As is seen from FIG. 1, when the ink ribbon unit 10 is properly set in a printer and the printer is energized, the ring 30 is driven by a certain driving means (not shown) installed in the printer. That is, upon energization of the printer, the ring 30 is turned half, by the driving means, relative to the shaft portion 24 of the feeding spool 20 which is then stopped. Due to the turning of the ring 30, at least one ribbon code label 35 on the outer cylindrical wall portion 33 of the ring 30 is detected by a known reflection type optical sensor 55 installed in the printer, so that the information on the ink film 11 is read.

Figure 3:
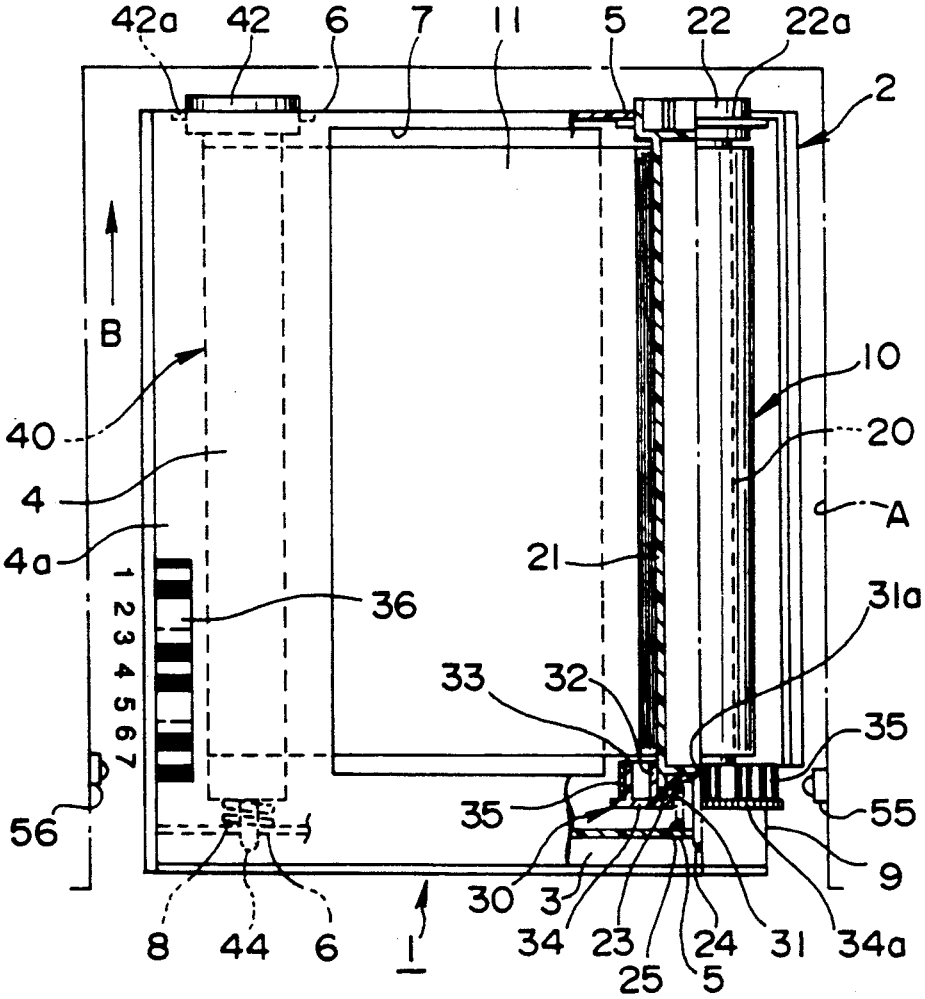
FIG. 3 is a plan view of an ink ribbon cassette according to the present invention, with some portions removed for clarification of the drawing.
Figure 4:
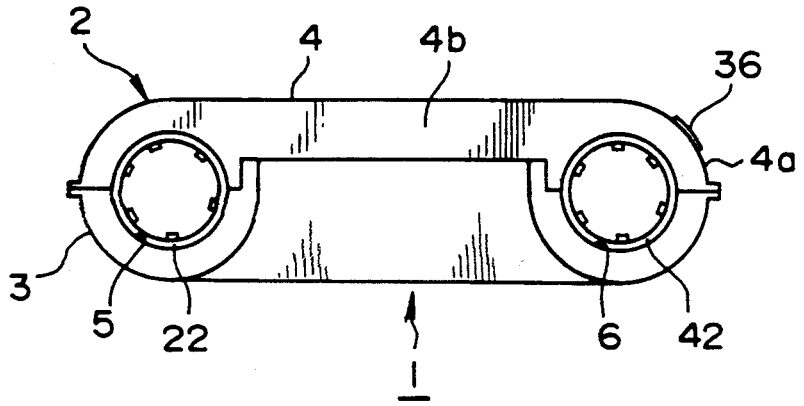
FIG. 4 is a front view of the ink ribbon cassette.

FIGS. 3 and 4 show an ink ribbon cassette 1 which contains therein the ink ribbon unit 10.

The ink ribbon cassette 1 comprises a plastic casing 2 which consists of lower and upper case parts 3 and 4. These case parts 3 and 4 have at their center portions respective rectangular apertures 7, so that the ink film 11 housed in the casing 2 is exposed to both the apertures 7. The casing 2 is formed at its one end with a pair of bearing portions 5 and 5 by which the enlarged end 22 and the shaft portion 24 of the above-mentioned feeding spool 20 are rotatably held. At the other end of the casing 2, there are formed another pair of bearing portions 6 and 6 by which both ends of a winding spool 40 are rotatably held. The winding spool 40 is used for winding thereon a used section of the ink film 11.

As is seen from FIG. 3, the upper case part 4 of the casing 2 has at its left end portion 4*a* a ribbon code label 36 stuck thereon. As is understood from FIG. 2, the ribbon code label 36 has an entire length "L1", which is provided by cutting portions corresponding to the start and parity bits of the bit pattern from the above-mentioned ribbon code label 36. The casing 2 is formed, at a portion facing the ring 30, with an opening 9. Like the feeding spool 20 biased toward the bearing portion 5 by the compression spring 25, the winding spool 40 is also biased toward the bearing portion 6 by another compression coiled spring 8.

Figure 5:
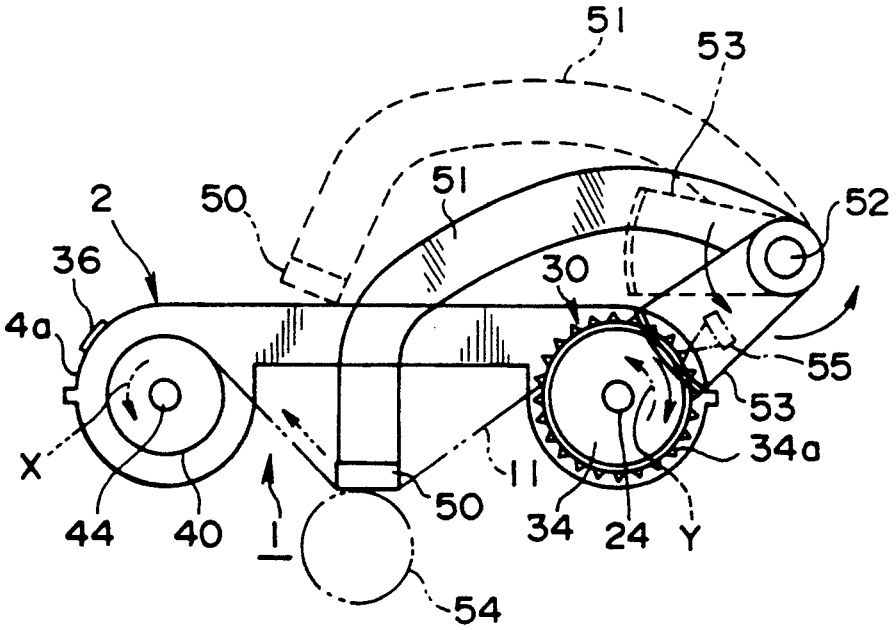
FIG. 5 is an illustration showing a condition wherein a driving mechanism drives the ring so that the ribbon code label on the ring is read by an optical sensor installed in a printer.

FIG. 5 shows a condition wherein the ink ribbon cassette 1 is properly set in a cassette holder "A" of a printer. In this drawing, denoted by numeral 50 is a printing head which is equipped with a heater, and denoted by numeral 51 is an arm which carries the printing head 50. The arm 51 has a pivot shaft 52 which pivots relative to a body of the printer. The shaft 52 has a sector gear 53 secured thereto, so that when the arm 51 is pivoted downward in FIG. 5, the sector gear 53 is brought into engagement with the gear 34*a* of the ring 30 housed in the ink ribbon cassette 1. When the arm 51 pivots to its lowermost operative position illustrated by a solid line, the printing head 50 presses the ink film 11 against a cylindrical platen 54 which is a rubber roller or the like.

Referring back to FIG. 3, the cassette holder "A" of the printer is equipped with first and second reflection type optical sensors 55 and 56. The first sensor 55 faces the ribbon code labels 35 of the ring 30, while, the second sensor 5 faces the ribbon code label 36 of the upper case part 4 of the casing 2 of the cassette 1.

As is seen from FIG. 3, in order to set the ink ribbon cassette 1 in the printer, the cassette 1 is slid into the cassette holder "A" of the printer from the direction of the arrow "B". During this sliding, the printer is energized and thus, the ribbon code label 36 on the casing 2 is read by the optical sensor 56. Thus, the information on the ink film 11 is read.

As will be seen from FIG. 5, after the ink ribbon cassette 1 is properly set in the cassette holder "A", the arm 51 is pivoted down from its uppermost rest position (shown by broken line). During this downward pivoting of the arm 51, the sector gear 53 is brought into engagement with the gear 34*a* of the ring 30, and thus with a subsequent downward pivoting of the arm 51 toward its lowermost position (as shown by solid line), the sector gear 53 turns the ring 30 by about 180 degrees. The turning of the ring 30 is made relative to the shaft portion 24 of the feeding spool 20 which is then stopped. Due to the turning of the ring 30, the information on one ribbon code label 35 is read by the optical sensor 55. Of course, this reading may be omitted since such information reading has been previously made at the time of sliding the cassette 1 into the cassette holder "A".

As is understood from the above, in the present invention, the reading of the information on the ink film 11 by the optical sensor 55 or 56 is carried out without turning the feeding spool 20. Thus, unlike in case of the afore-mentioned conventional cassette, wasteful usage of the ink film 11 is prevented and undesired slack of the ink film 11 is not produced.

Furthermore, due to absence of undesired slack of the ink film 11, the printer can start the printing work as soon as the same receives a printing instruction signal. That is, upon receiving the printing instruction signal, the printer drives the winding spool 40 in a direction as indicated by the arrow "X" in FIG. 5, that is, in the direction to wind thereon the ink film 11. With this, the ink film 11 is drawn from the feeding spool 20 turning the spool 20 in the direction of the arrow "Y" in FIG. 5. Because, under this condition, the gear 34*a* of the ring 30 is kept engaged with the sector gear 53, the ring 30 is kept stopped. That is, in this condition, the shaft portion 24 of the feeding spool 20 turns relative to the ring 30.

Since the ink ribbon unit 10 and the ink ribbon cassette 1 have respective ribbon code labels 35 and 36 carried thereon, they can be applied to various types of printers independently. When using the ink ribbon cassette 1, the reading of information on the ink film 11 is achieved by using only one of the optical sensors 55 and 56 of the printer.

Figure 6:
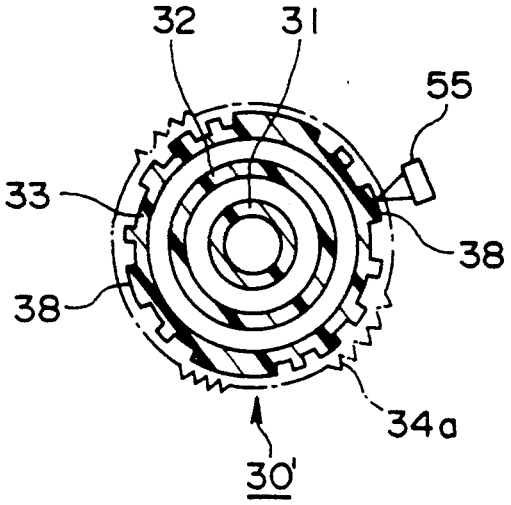
FIG. 6 is a view of a modified ring which is also usable in the present invention.

FIG. 6 shows a modified ring 30' which is usable in the present invention in place of the above-mentioned ring 30. The ring 30' is formed about its cylindrical outer surface 33 with a plurality of projections 38 which constitute an information code of the ink film 11. Thus, when the ring 30' is rotated by the sector gear 53 upon setting of the ink ribbon cassette 1 in the printer (see FIG. 5), the information code is read by the optical sensor 55.

If desired, depressed portions defined between the adjacent projections 38 may be painted with a suitable color for indicating the printing capacity of the ink film 11. That is, if the ink film 11 has a printing capacity dealing with about one hundred pieces of paper, the depressed portions may be colored blue, if the ink film 11 has the printing capacity dealing with about fifty pieces of paper, the depressed portions may be colored red and if the film 11 has the printing capacity dealing with about twenty five pieces of paper, the depressed portions may be colored with green. With these colors, the operator of the printer can easily realize the printing capacity of the cassette 1 before handling the printer.

Figure 7:
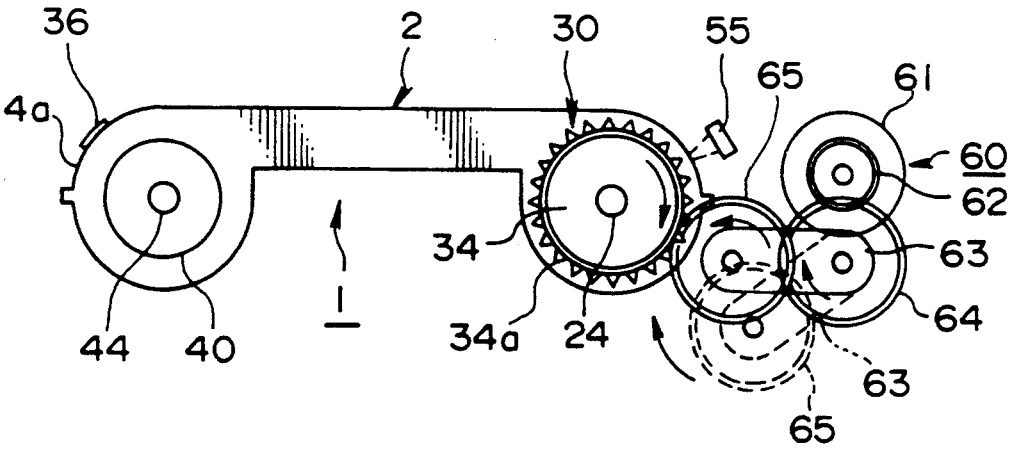
FIG. 7 is a view similar to FIG. 5, but showing another driving mechanism by which a ring on which the ribbon code label is stuck is driven.

FIG. 7 shows another driving mechanism 60 for the ring 30, which mechanism 60 is usable in place of the sector gear 53 of FIG. 5. As shown, the driving mechanism 60 comprises an electric motor 61, two meshed gears 64 and 65 and a pivotal holder 63 on which the meshed gears 64 and 65 are rotatably held. The gear 64 is powered by the motor 61. When reading the information on the ribbon code label 35 is needed, the pivotal holder 63 is pivoted upward to engage the gear 65 with the gear 34*a* of the ring 30.

Figure 8:
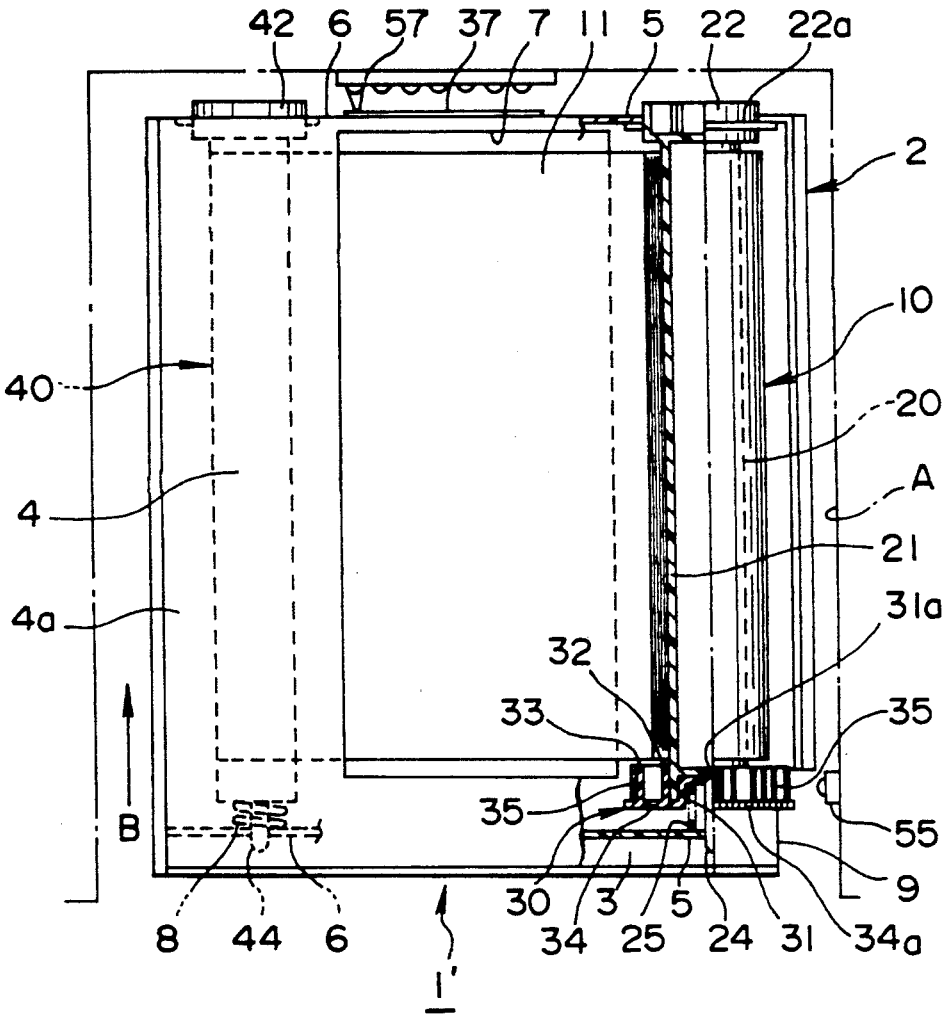
FIGS. 8 and 9 are views similar to FIGS. 3 and 4, but showing another ink ribbon cassette according to the present invention.
Figure 9:
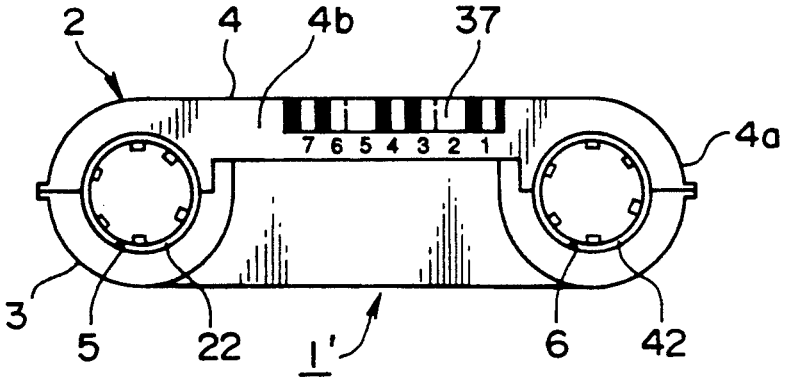
Figure 10:
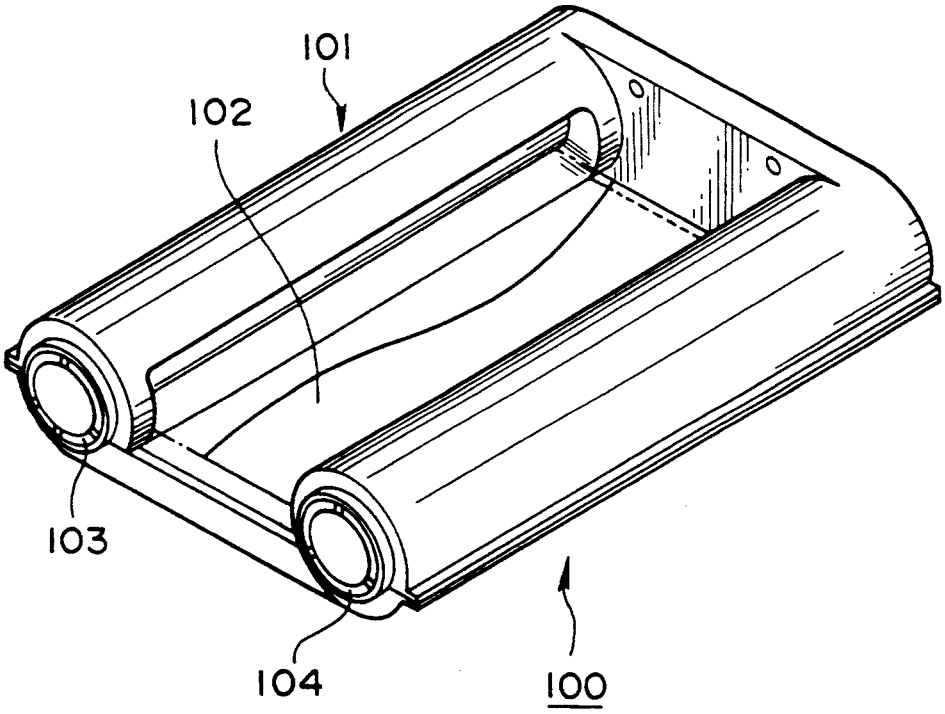
FIG.10 (PRIOR ART)
FIG. 10 is a view of a conventional ink ribbon cassette.

FIGS. 8 and 9 show another ink ribbon cassette 1' which is a slight modification of the above-mentioned cassette 1. Parts identical to those of the cassette 1 are denoted by the same numerals.

As is seen from FIG. 9, in this modification, a ribbon code label 37 which corresponds to the above-mentioned label 36 (see FIG. 3) is stuck on a front surface 4*b* of the plastic casing 2. As is seen from FIG. 8, in order to read information on the label 37 of the cassette 1', a reflection type optical sensor 57 is installed at innermost portion of the cassette holder "A" of the printer.

What is claimed is:

1. An ink ribbon unit comprising:

an ink film;

a spool around which said ink film is wound, said spool having a coaxial shaft portion;

a ring disposed about the coaxial shaft portion of said spool so as to be relatively rotatable with respect to the coaxial shaft portion;

a mark representing information pertaining to said ink film, said mark being applied to said ring to rotate therewith; and drive means associated with said ring for enabling said ring to be driven to rotate with respect to coaxial shaft portion while said coaxial shaft portion is stationary.

2. An ink ribbon unit as claimed in claim 1, in which said mark comprises at least two ribbon code labels which are stuck on an outer cylindrical surface of said ring in a manner to surround the same, each label covering a half of the cylindrical surface.

3. An ink ribbon unit as claimed in claim 2, wherein said at least two ribbon code labels are adapted to be read by a single optical sensor.

4. An ink ribbon unit as claimed in claim 1, in which said mark comprises a plurality of projections formed around the cylindrical outer surface of said ring, said projections constituting an information code of said ink film.

5. An ink ribbon unit as claimed in claim 4, in which depressed portions defined between the adjacent projections of said ring are painted with a color for indicating the printing capacity of the ink film.

6. An ink ribbon unit as claimed in claim 1, in which said spool is a feeding spool which feeds said ink film when in use.

7. An ink ribbon unit as claimed in claim 6, in which said drive means comprises a gear which is formed on said ring and through which a driving force is applicable from an external driving means to induce said ring to rotate with respect to said coaxial shaft portion.

8. An ink ribbon unit as claimed in claim 7, in which said ring comprises:

a depressed portion which has a center opening rotatably received on said shaft portion of the feeding spool;

an inner cylindrical wall portion which is rotatably disposed about one axial end of said feeding spool, said axial end surrounding said shaft portion;

an outer cylindrical wall portion which coaxially surrounds said inner cylindrical wall portion; and a circular plate portion which is integral with all of the depressed portion and said inner and outer cylindrical wall portions.

9. An ink ribbon unit as claimed in claim 8, in which said each of said feeding spool and said ring is constructed of a plastic.

10. An ink ribbon unit as claimed in claim 8, in which said feeding spool has the other cylindrical end which is enlarged and integrally formed with a flange.

11. An ink ribbon unit as claimed in claim 8, in which said circular plate portion of said ring is formed at its circumference with a plurality of teeth which constitute said gear.

12. An ink ribbon cassette comprising:

a casing consisting of upper and lower case parts;

an ink ribbon unit installed in said casing, said ink ribbon unit including an ink film;

a spool on which said ink film is wound;

a coaxial shaft portion extending from one end of said spool;

a ring disposed about the coaxial shaft portion of said spool so as to be relatively rotatable with respect to the coaxial shaft portion, said ring including means operatively engageable with a drive source which is disposed outside of said casing, for enabling said ring to be driven to independently rotate relative to said coaxial shaft portion;

a first mark representing information pertaining to said ink film, said mark being applied to said ring to rotate therewith; and a second mark which represents information pertaining to said ink film, said second mark being attached to said casing.

13. An ink ribbon cassette as claimed in claim 12, further comprising a winding spool which is installed in said casing to wind up thereon said ink film.

14. An ink ribbon cassette as claimed in claim 13, in which the upper and lower case parts have their center portions respective apertures, so that said ink film in said casing is exposed to both the apertures.

15. An ink ribbon cassette as claimed in claim 14, in which the mark of said ink ribbon unit comprises at least two ribbon code labels which are stuck on an outer cylindrical surface of said ring in a manner to surround the same, each label covering a half of said cylindrical surface, and in which said another mark of said casing is stuck on a left end portion of the casing or a front surface of the casing.

16. An ink ribbon cassette as claimed in claim 15, in which said casing is constructed of a plastic and has therein bearing portions by which said feeding and winding spools are rotatably held.

17. An ink ribbon cassette as claimed in claim 16, in which said ring of said ink ribbon unit is formed with a gear through which a driving force is applied from an external driving means to said ring to rotate the same when said ink ribbon cassette is in use.

18. An ink ribbon cassette as claimed in claim 17, in which said winding spool is driven by another external driving means in a direction to wind thereon said ink film.

19. An ink ribbon cassette as claimed in claim 18, in which each of said feeding and winding spools is biased by spring means in one direction relative to said casing.

* * * * *